US006946240B2

(12) United States Patent
Rao et al.

(10) Patent No.: US 6,946,240 B2
(45) Date of Patent: Sep. 20, 2005

(54) IMAGING MATERIAL WITH IMPROVED SCRATCH RESISTANCE

(75) Inventors: YuanQiao Rao, Pittsford, NY (US); Joseph S. Sedita, Albion, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/633,806

(22) Filed: Aug. 4, 2003

(65) Prior Publication Data

US 2005/0031982 A1 Feb. 10, 2005

(51) Int. Cl.[7] ..... G03C 1/79; G03C 1/76; G03C 1/93

(52) U.S. Cl. ..... 430/531; 430/200; 430/201; 430/523; 430/533; 430/534; 430/536; 430/539; 430/961; 428/32.34; 428/32.37; 428/32.5

(58) Field of Search ..... 430/200, 201, 430/523, 531, 533, 534, 536, 539, 961; 428/32.5, 32.34, 32.37

(56) References Cited

U.S. PATENT DOCUMENTS

| | | | | |
|---|---|---|---|---|
| 2,173,480 | A | 9/1939 | Jung | |
| 2,259,009 | A | 10/1941 | Talbot | |
| 2,331,746 | A | 10/1943 | Talbot | |
| 2,536,764 | A | 1/1951 | Moulton | |
| 2,706,686 | A | 4/1955 | Hilborn | |
| 2,798,004 | A | 7/1957 | Weigel | |
| 3,113,867 | A | 12/1963 | Van Norman et al. | |
| 3,190,197 | A | 6/1965 | Pinder | |
| 3,397,980 | A | 8/1968 | Stone | |
| 3,415,670 | A | 12/1968 | McDonald | |
| 3,443,946 | A | 5/1969 | Grabhofer et al. | |
| 3,502,501 | A | 3/1970 | Burczyk et al. | |
| 3,617,354 | A | 11/1971 | Carnahan et al. | |
| 3,697,277 | A | 10/1972 | King | |
| 3,733,293 | A | 5/1973 | Gallagher et al. | |
| 4,092,173 | A | 5/1978 | Novak et al. | |
| 5,179,065 | A | 1/1993 | Ito | |
| 5,478,709 | A | 12/1995 | Vandenabeele | |
| 5,552,469 | A | 9/1996 | Beall et al. | |
| 5,578,672 | A | 11/1996 | Beall et al. | |
| 5,683,862 | A | 11/1997 | Majumdar et al. | |
| 5,753,426 | A | 5/1998 | Nair et al. | |
| 5,866,287 | A | 2/1999 | Christian et al. | |
| 5,869,217 | A | 2/1999 | Aono | |
| 5,869,227 | A | 2/1999 | Majumdar et al. | |
| 5,891,611 | A | 4/1999 | Majumdar et al. | |
| 6,060,230 | A | 5/2000 | Christian et al. | |
| 6,127,105 | A | 10/2000 | Vandenabeele | |
| 6,475,696 | B2 | 11/2002 | Majumdar et al. | |
| 6,641,973 | B1 | 11/2003 | Dontula et al. | |
| 6,667,148 | B1 | 12/2003 | Rao et al. | |
| 6,841,226 | B2 * | 1/2005 | Dontula et al. | 428/195.1 |
| 2003/0021983 | A1 | 1/2003 | Nohr et al. | |
| 2003/0099815 | A1 * | 5/2003 | Dontula et al. | 428/195 |
| 2003/0100656 | A1 * | 5/2003 | Majumdar et al. | 524/445 |

FOREIGN PATENT DOCUMENTS

| | | |
|---|---|---|
| EP | 0 780 340 B1 | 3/2002 |
| WO | 93/11190 | 6/1993 |

* cited by examiner

*Primary Examiner*—Richard L. Schilling
(74) *Attorney, Agent, or Firm*—Lynne M. Blank

(57) ABSTRACT

The present invention relates to an imaging element comprising a support, an imaging layer, and at least one layer comprising a clay nanocomposite wherein said nanocomposite comprises a splayant and at least one natural clay particle having an aspect ratio of from 20:1 to 500:1.

18 Claims, 1 Drawing Sheet

*GELATIN (5g CONSTANT LOAD, 3 MIL STYLUS) (20X/2X)*

GELATIN (5g CONSTANT LOAD, 3 MIL STYLUS) (20X/2X)

GELATIN + 10% CLOISITE (5g CONSTANT LOAD, 3 MIL STYLUS) (20X/2X)

GELATIN + 5% CLOISITE (5g CONSTANT LOAD, 3 MIL STYLUS) (20X/2X)

GELATIN +5% LAPONITE (5g CONSTANT LOAD, 3 MIL STYLUS) (20X?2X)

IMAGING MATERIAL WITH IMPROVED SCRATCH RESISTANCE

CROSS-REFERENCE TO RELATED APPLICATIONS

Reference is made to commonly assigned, co-pending U.S. patent application Ser. No. 10/633,904 by YuanQiao Rao filed of even date herewith entitled "Imaging Material With Improved Mechanical Properties", the disclosure of which is incorporated herein.

FIELD OF THE INVENTION

The present invention relates to imaging elements having improved mechanical properties as a result of incorporation of a natural clay-containing layer.

BACKGROUND OF THE INVENTION

Photographic elements having protective overcoat layers are well known and a wide variety of different coating compositions have been proposed in the past for use as protective overcoats. Such overcoats serve a number of different purposes, such as to provide protection against fingerprints, abrasion and scratching, to protect against water spotting, to provide a particular surface texture such as a matte surface, to provide protection against blocking, and to act as anti-reflection layers which reduce glare. Layers of a temporary nature which are intended to be removed after they have served their purpose and layers which are permanently bonded to the photographic element have been described in the prior art. Protective overcoats can be applied to photographic elements by coating solutions or dispersions of film-forming agents in organic solvents such as are described, for example, in U.S. Pat. Nos. 2,259,009; 2,331,746; 2,706,686; 3,113,867; 3,190,197 and 3,415,670; by coating of aqueous film-forming compositions such as are described, for example in U.S. Pat. Nos. 2,173,480; 2,798,004; 3,502,501 and 3,733,293; by coating of compositions containing discrete, transparent, solid particles of submicroscopic size as described in U.S. Pat. No. 2,536,764; by coating of plasticized polymer compositions as described in U.S. Pat. No. 3,443,946; by coating of polymerized perfluorinated olefins as described in U.S. Pat. No. 3,617,354; by lamination of a protective layer as described, for example, in U.S. Pat. Nos. 3,397,980 and 3,697,277; and by radiation curing of polymer precursor as described in U.S. Pat. No. 4,092,173.

Protective overcoats known heretofore have suffered from various diasadvantages which have greatly limited their usefulness. For example, though numerous types of overcoats have been proposed, none has been fully satisfactory in providing abrasion and scratch resistance for photographic elements which are commonly subjected to severe conditions in handling and use, such as microfiche and motion picture films. These outermost layers will experience abuse in the preparation and use of the photographic films, through, for example, handling and transport through rollers, resulting in abrasion and scratching. Protective overcoats for such elements must meet exacting requirements with respect to factors such as transparency and flexibility as well as abrasion resistance and scratch resistance, and must be very strongly bonded to the underlying material to avoid the possibility of delamination. Protective overcoats meeting all of these requirements have long been sought without success.

PROBLEM TO BE SOLVED

The problem to be solved is to improve the scratch resistance and physical integrity of the outermost layers in photographic materials without sacrificing transparency and flexibility.

SUMMARY OF THE INVENTION

The present invention relates to an imaging element comprising a support, an imaging layer, and at least one layer comprising a clay nanocomposite wherein said nanocomposite comprises a splayant and at least one natural clay particle having an aspect ratio of from 20:1 to 500:1.

ADVANTAGEOUS EFFECT OF THE INVENTION

The present invention includes several advantages, not all of which are incorporated in a single embodiment. An image element containing an outermost layer containing clay nanoparticulate may meet all the requirements for a protective layer, such as physical integrity and scratch resistance, while providing excellent bonding with the other image layers. The imaging element may be used in films, motion picture films, paper prints, or microfiche or may be used with black-and-white elements, color elements formed from a negative in a negative—positive process, or color elements formed directly by a reversal process.

DETAILED DESCRIPTION OF THE INVENTION

Figure 1:
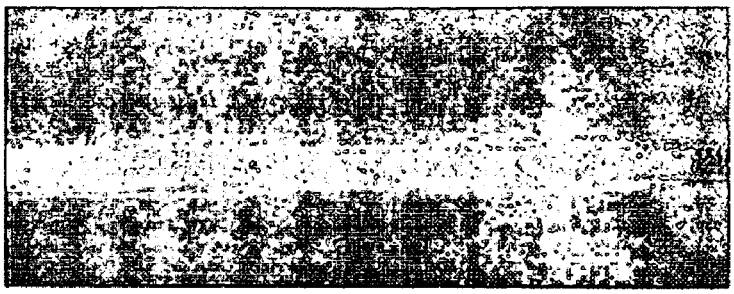
FIG. 1 illustrates the visual appearance of Example C-2, using coating solution S-1 (gelatin), after being subjected to scratch resistance testing with 5 gm. constant load and 3 mil stylus.

The present invention relates to an imaging element comprising a support, an imaging layer, and at least one layer comprising a clay nanocomposite comprising an splayant, that is, an intercalant and/or exfoliant, and at least one natural clay particle having aspect ratio of from 20:1 to 500:1.

Whenever used in the specification the terms set forth shall have the following meaning:

"Aspect Ratio" means the relationship of the length (L) of a particle to its thickness (t) expressed as L:t.

"Nanocomposite" means a composite material wherein at least one component comprises an inorganic phase, such as a smectite layered material, with at least one dimension in the 0.1 to 100 nanometer range.

"Plates" means particles with two comparable dimensions significantly greater than the third dimension, for example, length and width of the particle being of comparable size but orders of magnitude greater than the thickness of the particle.

"Layered material" means an inorganic material such as a smectite layered material that is in the form of a plurality of adjacent bound layers.

"Platelets" means individual layers of the layered material.

"Intercalation" means the insertion of one or more foreign molecules or parts of foreign molecules between platelets of the layered material, usually detected by X-ray diffraction technique, as illustrated in U.S. Pat. No. 5,891,611 (line 10, col. 5—line 23, col. 7).

"Intercalant" means the aforesaid foreign molecule inserted between platelets of the aforesaid layered material.

"Intercalated" refers to layered material that has at least partially undergone intercalation and/or exfoliation.

"Exfoliation" or "delamination" means separation of individual platelets in to a disordered structure, without any stacking order.

"Organo layered material" means layered material modified by organic molecules.

"Splayed" layered materials are defined as layered materials which are completely intercalated with no degree of exfoliation, totally exfoliated materials with no degree of intercalation, as well as layered materials which are both intercalated and exfoliated including disordered layered materials.

"Splaying" refers to the separation of the layers of the layered material, which may be to a degree, which still maintains a lattice-type arrangement, as in intercalation, or to a degree which spreads the lattice structure to the point of loss of lattice structure, as in exfoliation, or a combination of both.

The layered materials most suitable for this invention include natural materials in the shape of plates with significantly high aspect ratio, especially materials having an aspect ration of at least 20:1. However, other shapes with high aspect ratio will also be advantageous. The preferred layered materials for use in the present invention include natural clays, especially natural smectite clay such as montmorillonite, nontronite, beidellite, volkonskoite, hectorite, saponite, sauconite, sobockite, stevensite, svinfordite, halloysite, magadiite, kenyaite and vermiculite as well as layered double hydroxides or hydrotalcites. Most preferred layered materials include natural montmorillonite, hectorite and hydrotalcites, because of commercial availability of these materials.

The layered materials suitable for this invention may comprise phyllosilicates, for example, montmorillonite, particularly sodium montmorillonite, magnesium montmorillonite, and/or calcium montmorillonite, nontronite, beidellite, volkonskoite, hectorite, saponite, sauconite, sobockite, stevensite, svinfordite, vermiculite, magadiite, kenyaite, talc, mica, kaolinite, and mixtures thereof. Other useful layered materials may include illite, mixed layered illite/smectite minerals, such as ledikite and admixtures of illites with the layered materials named above. Other useful layered materials, particularly useful with anionic matrix polymers, may include the layered double hydroxide clays or hydrotalcites, such as $Mg_6Al_{3.4}(OH)_{18.8}(CO_3)_{1.7}H_2O$, which have positively charged layers and exchangeable anions in the interlayer spaces. Preferred layered materials are swellable so that other agents, usually organic ions or molecules, may splay, that is, intercalate and/or exfoliate, the layered material resulting in a desirable dispersion of the inorganic phase. These swellable layered materials include phyllosilicates of the 2:1 type, as defined in the literature (vide, for example, "An introduction to clay colloid chemistry," by H. van Olphen, John Wiley & Sons Publishers). Typical phyllosilicates with ion exchange capacity of 50 to 300 milliequivalents per 100 grams are preferred.

For this invention, the natural clay particles should have a length greater than 0 and less than 700 nm (0.71 $\mu$m). In a preferred embodiment, the natural clay particle may have a lateral dimension of from 0.01 $\mu$m to 5 $\mu$m, and more preferably from 0.05 $\mu$m to 2 $\mu$m, and most preferably from 0.1 $\mu$m to 1 $\mu$m. The thickness or the vertical dimension of the clay particles may vary from 0.5 nm to 10 nm, and preferably from 1 nm to 5 nm. The aspect ratio is greater than 20:1, more preferably from 20:1 to 500:1, and most preferably from 100:1 to 400:1. The aforementioned limits regarding the size and shape of the particles are to ensure adequate improvements in some properties of the nanocomposites without deleteriously affecting others. For example, a large lateral dimension may result in an increase in the aspect ratio, a desirable criterion for improvement in mechanical and scratch properties. However, very large particles may cause optical defects, such as haze, and may be abrasive to processing, conveyance and finishing equipment as well as the imaging layers.

In one embodiment, the clay-containing layer may comprise from 2 to 20 weight percent of the natural clay particles. It is preferred to have 2 to 10 weight percent of the natural clay particles.

Any material capable of splaying, that is, intercalating, exfoliating or a combination thereof, the natural clay particle used in the present invention may be used as the splayant, that is, the intercalant or the exfoliant. Suitable materials capable of intercalation may include water soluble or water insoluble polymers, organic reagents or monomers, silane compounds, metals or organometallics, organic cations to effect cation exchange, and combinations thereof. Materials used as splayants, that is, intercalants and/or exfoliants, may include polyvinyl alcohol (PVA), polyvinyl pyrrolidone (PVP), polyethylene oxide (PEO), plyether block polyamide copolymers, hydrophilic colloids, such as gelatin, and poly (carboxylic acids), a poly(sulfonic acid), poly(acrylamides), quaternized polymers and mixtures thereof. The use of one or more hydrophilic polymer is especially preferred. The use of organic splayants is also preferred.

The hydrophilic polymers useful as splayants with the present invention may include gelatin or gelatin grafted polymers. Gelatin is a common main binder for photographic imaging layers. Typical photosensitive layers may be image-forming layers containing photographic silver halides such as silver chloride, silver bromide, silver bromoiodide, silver chlorobromide and the gelatin. Any of the known types of gelatin, used in imaging elements may be used, as per the invention. These include, for example, alkali-treated gelatin (cattle bone or hide gelatin), acid-treated gelatin (pigskin or bone gelatin), modified gelatins such as those disclosed in U.S. Pat. No. 6,077,655 and references cited therein, gelatin derivatives such as partially phthalated gelatin, and acetylated gelatin, preferably deionized gelatins as well as gelatin grafted onto vinyl polymers, such as those disclosed in U.S. Pat. Nos. 4,855,219; 5,066,572; 5,248,558; 5,330,885; 5,910,401; 5,948,857; 5,952,164; and references therein. Other hydrophilic colloids that may be utilized in the present invention, either alone or in combination with gelatin, include dextran, gum arabic, zein, casein, pectin, collagen derivatives, collodion, agar-agar, arrowroot, and albumin. Still other useful hydrophilic colloids are water-soluble polyvinyl compounds such as polyvinyl alcohol, polyacrylamide, and poly(vinylpyrrolidone).

Suitable polymers for use as splayants with the present invention may include polymers known in the art, for example as described in U.S. Pat. No. 5,683,862 (Majumdar et al.), U.S. Pat. No. 5,891,611 (Majumdar et al.), and U.S. Pat. No. 6,060,230 (Christian et al.). The water soluble polymers can comprise polyalkylene oxides such as polyethylene oxide, poly 6,(2-ethyloxazolines), poly (ethyleneimine), poly(vinyl pyrrolidone), poly(vinyl alcohols), poly(vinyl acetate), poly(styrene sulfonate), poly (acrylamides), poly(methacrylamides), poly(N,N-dimethacrylamide), poly(N-isopropylacrylamide), polysaccharides, dextrans, and cellulose derivatives such as carboxymethyl cellulose, hydroxyethyl cellulose, and others known in the art.

There are two major intercalation approaches generally used to accomplish intercalation—intercalation of a suitable monomer followed by polymerization (known as in-situ polymerization, see A. Okada et. Al., *Polym Prep.*, Vol. 28, 447, 1987) or monomer/polymer intercalation from solution. The splaying capability of the selected splayant (intercalant and/or exfoliant) may be controlled or effected by various factors, such as concentration of the splayant, delivery medium, for example, delivery of the splayant in solution, and functionality of the splayant.

Examples of useful pretreatment with polymers and oligomers include those disclosed in U.S. Pat. Nos. 5,552,469 and 5,578,672, incorporated herein by reference. Examples of useful hydrophobic polymers for intercalating the platelet particles include polytetrahydrofuran, polystyrene, polycaprolactone, certain water dispersable polyesters, and Nylon-6. Examples of useful pretreatment with organic reagents and monomers include those disclosed in EP 780, 340 A1, incorporated herein by reference. Examples of useful organic reagents and monomers for intercalating the platelet particles include dodecylpyrrolidone, caprolactone, aprolactam, ethylene carbonate, ethylene glycol, bishydroxyethyl terephthalate, and dimethyl terephthalate or mixtures thereof. Examples of useful pretreatment with silane compounds include those treatements disclosed in WO 93/11190, incorporated herein by reference. Examples of useful silane compounds includes (3-glycidoxypropyl) trimethoxysilane, 2-methoxy (polyethyleneoxy)propyl heptamethyl trisiloxane, and octadecyl dimethyl (3-trimethoxysilylpropyl) ammonium chloride. Examples of useful organic cations include, but are not limited to, alkyl ammonium ions, such as dodecyl ammonium, octadecyl ammonium, bis(2-hydroxyethyl) octadecyl methyl ammonium, octadecyl benzyl dimethyl ammonium, and tetramethyl ammonium or mixtures thereof, and alkyl phosphonium ions such as tetrabutyl phosphonium, trioctyl octadecyl phosphonium, tetraoctyl phosphonium, and octadecyl triphenyl phosphonium, or mixtures thereof. Illustrative examples of suitable polyalkoxylated ammoniium compounds include those available under the trade name Ethoquad® or Ethomeen® from Akzo Chemie America, namely, Ethoquad® 18/25 which is octadecyl methyl bis (polyoxyethylene[15]) ammonium chloride and Ethomeen® 18/25 which is octadecyl bis(polyoxyethylene[15])amine, wherein the numbers in brackets refer to the total number of ethylene oxide units. The most preferred organic cation is octadecyl methyl bis(polyoxyethylene {15}) ammonium chloride.

The splayant, that is, the intercalant and/or exfoliant, for use in the present invention may be monomeric, oligomeric or polymeric. Some useful ionic compounds may include cationic surfactants including onium species such as ammonium (primary, secondary, tertiary, and quaternary), phosphonium, or sulfonium derivatives of aliphatic, aromatic or arylaliphatic amines, phosphines and sulfides. Typically onium ions may cause intercalation in the layers through ion exchange with the metal cations of the preferred smectite clay In one preferred embodiment, the splayant, that is, the intercalant and/or exfoliant, comprises from 30 to 90 percent weight percent of the layer containing the natural clay particle.

The clay-containing layer used in the present invention may include other materials, as well. Exemplary materials may include hardeners, crosslinking agents, surfactants, thickeners, coalescing aids, particle dyes, matte beads and lubricants.

The layer of the invention may comprise any number of hardeners or crosslinking agents in any amount known in the art for use in imaging elements. Preferred hardeners include 1,2-bis(vinylsulfonylacetamido)ethane (BVSAE), bis (vinylsulfonyl)methane (BVSM), bis(vinylsulfonylmethyl) ether (BVSME) and bis(vinylsulfonylethyl)ether (BSEE), 1,3-bis(vinylsulfonyl)propane (BVSP), 1,3-bis (vinylsulfonyl)-2-hydroxypropane (BVSHP), 1,1,1,-bis (vinylsulfonyl)ethylbenzenesulfonate sodium salt, 1,1,1-tris (vinylsulfonyl)ethane (TVSE), tetrakis(vinylsulfonyl) methane, tris(acrylamido)hexahydro-s-triazine, copoly (acrolein-methacrylic acid), glycidyl ethers, acrylamides, dialdehydes, blocked dialdehydes, alpha-diketones, active esters, sulfonate esters, active halogen compounds, s-triazines, diazines, epoxides, formaldehydes, formaldehyde condensation products anhydrides, aziridines, active olefins, blocked active olefins, mixed function hardeners such as halogen-substituted aldehyde acids, vinyl sulfones containing other hardening functional groups, 2,3-dihydroxy-1,4-dioxane (DHD), potassium chrome alum, polymeric hardeners such as polymeric aldehydes, polymeric vinylsulfones, polymeric blocked vinyl sulfones and polymeric active halogens. The hardener may be incorporated in any amount to provide cross-linking not only to the overcoat layer of the invention but also to any other layer(s) of the imaging element.

The clay-containing layer of the invention may be formed on any support, with particular preference for those, which are known for their application as supports in imaging members. The clay-containing layer preferably comprises an outermost layer on either the image side or the non-image side of the support, a protective overcoat layer, or a layer wherein the imaging layer is between the support and the clay-containing layer. In a preferred embodiment, the element comprises a dry weight coverage of from 10 mg/m$^2$ to 10,000 mg/m$^2$ of the clay-containing layer, and, preferably, a dry weight coverage of from 200 to 2000 mg/m$^2$ of the clay-containing layer. The Young's modulus of the support may be enhanced by the presence of the clay-containing layer by at least 10%, or, preferably, by at least 20%. In one preferred embodiment, the clay-containing layer is one the side of the element opposite the imaging layer(s) and the clay-containing layer is from 8 to 50 microns in thickness.

In a preferred embodiment, the support comprises a polymer sheet. The polymer sheet may comprise homopolymer(s), copolymer(s) and/or mixtures thereof. Typical imaging supports comprise cellulose nitrate, cellulose acetate, poly(vinyl acetate), polystyrene, polyolefins including polyolefin ionomers, polyesters including polyester ionomers, polycarbonate, polyamide, polyimide, metals, glass, natural and synthetic paper, resin-coated, polymer-coated or laminated paper, voided polymers including polymeric foam, microvoided polymers and microporous materials, or fabric, or any combinations thereof. Preferred polymers are polyesters, polyolefins and polystyrenes, mainly chosen for their desirable physical properties and cost. The present invention may also be coated onto non-imaging supports, such as metal.

Suitable polyolefins for use in the support may include polyethylene, polypropylene, polymethylpentene, polystyrene, polybutylene and mixtures thereof. Polyolefin copolymers, including copolymers of propylene and ethylene such as hexene, butene and octene and mixtures thereof are also useful.

Suitable polyesters for use in the support may include those, which are derived from the condensation of aromatic, cycloaliphatic, and aliphatic diols with aliphatic, aromatic and cycloaliphatic dicarboxylic acids and may be cycloaliphatic, aliphatic or aromatic polyesters. Exemplary of useful cycloaliphatic, aliphatic and aromatic polyesters which may be utilized in the practice of their invention are poly(ethylene terephthalate), poly(cyclohexlenedimethylene), poly(ethylene dodecate), poly(butylene terephthalate), poly(ethylene naphthalate), poly(ethylene(2,7-naphthalate)), poly(methaphenylene isophthalate), poly(glycolic acid), poly(ethylene succinate), poly(ethylene adipate), poly(ethylene sebacate), poly(decamethylene azelate), poly(ethylene sebacate), poly(decamethylene adipate), poly(decamethylene sebacate), poly(dimethylpropiolactone), poly(para-hydroxybenzoate), poly(ethylene oxybenzoate), poly(ethylene isophthalate), poly(tetramethylene terephthalate, poly(hexamethylene terephthalate), poly(decamethylene terephthalate), poly(1,4-cyclohexane dimethylene terephthalate) (trans), poly(ethylene 1,5-naphthalate), poly(ethylene 2,6-naphthalate), poly(1,4-cyclohexylene dimethylene terephthalate) (cis), and poly(1,4-cyclohexylene dimethylene terephthalate (trans) and copolymers and/or mixtures thereof.

Preferred polyesters for use in the support may include poly(ethylene terephthalate), poly(butylene terephthalate), poly(1,4-cyclohexylene dimethylene terephthalate), poly(ethylene isophthalate), and poly(ethylene naphthalate) and copolymers and/or mixtures thereof. Among these polyesters of choice, poly(ethylene terephthalate), which may be modified by small amounts of other monomers, is most preferred.

The support, preferably a polymer sheet, may comprise a single layer or multiple layers according to need. The multiplicity of layers may include any number of auxiliary layers such as antistatic layers, backmark retention layers, tie layers or adhesion promoting layers, abrasion resistant layers, curl control layers, cuttable layers, conveyance layers, barrier layers, splice providing layers, UV absorption layers, antihalation layers, optical effect providing layers, waterproofing layers, flavor retaining layers, fragrance providing layers, adhesive layers, and imaging layers.

The polymer sheet may be formed by any method known in the art such as those involving extrusion, coextrusion, quenching, orientation, heat setting, lamination, coating and solvent casting. It is preferred that the polymer sheet is an oriented sheet formed by any suitable method known in the art, such as by a flat sheet process or a bubble or tubular process. The flat sheet process involves extruding or coextruding the materials of the sheet through a slit die and rapidly quenching the extruded or coextruded web upon a chilled casting drum so that the polymeric component(s) of the sheet are quenched below their solidification temperature.

The polymer sheet may be subjected to any number of coatings and treatments, after extrusion, coextrusion, orientation, or between casting and full orientation, to improve its properties, such as printability, barrier properties, heat-sealability, spliceability, adhesion to other supports and/or imaging layers.

Examples of such coatings may be acrylic coatings for printability, or polyvinylidene halide for heat seal properties. Examples of such treatments may be flame, plasma and corona discharge treatment, ultraviolet radiation treatment, ozone treatment and electron beam treatment to improve printability and adhesion. Further examples of treatments may be calendaring, embossing and patterning to obtain specific effects on the surface of the web. The polymer sheet may be further incorporated in any other suitable support by lamination, adhesion, cold or heat sealing, extrusion coating, or any other method known in the art.

The polymer sheets most preferred for application in the present invention are the polymeric supports disclosed in U.S. Pat. Nos. 3,411,908; 3,501,298; 4,042,398; 4,188,220; 4,699,874; 4,794,071; 4,801,509; 5,244,861; 5,326,624; 5,395,689; 5,466,519; 5,780,213; 5,853,965; 5,866,282; 5,874,205; 5,888,643; 5,888,681; 5,888,683; 5,902,720; 5,935,690; 5,955,239; 5,994,045; 6,017,685; 6,017,686; 6,020,116; 6,022,677; 6,030,742; 6,030,756; 6,030,759; 6,040,036; 6,043,009; 6,045,965; 6,063,552; 6,071,654; 6,071,680; 6,074,788; 6,074,793; 6,083,669; 6,153,367; 6,180,227; and 6,197,486; These supports may comprise natural or synthetic paper, coated or laminated resin layers, voided polymers, specifically microvoided polymers, non-voided polymers, woven polymer fibers, cloth, and various combinations thereof, in mainly image display applications. Other most preferred polymeric supports include those disclosed in U.S. Pat. Nos. 5,138,024; 5,288,601; 5,334,494; 5,360,708; 5,372,925; 5,387,501; 5,453,349; 5,556,739; 5,580,709; 6,207,361 in mainly image capture applications.

Used herein, the phrase 'imaging element' comprises an imaging support as described above along with an image receiving layer as applicable to multiple techniques governing the transfer of an image onto the imaging element. Such techniques include thermophotographic imaging utilizing, for example, thermal dye transfer, electrophotographic printing, or ink jet printing, as well as a support for photographic silver halide images. As used herein, the phrase "photographic element" is a material that utilizes photosensitive silver halide in the formation of images.

The preferred photographic element is a material that utilizes photosensitive silver halide in the formation of images. The photographic elements may be single color elements or multicolor elements. Multicolor elements contain image dye-forming units sensitive to each of the three primary regions of the spectrum. Each unit may comprise a single coupler and emulsion layer or multiple coupler and emulsion layers each sensitive to a given region of the spectrum. The layers of the element, including the layers of the image-forming units, may be arranged in various orders as known in the art. In an alternative format, the emulsions sensitive to each of the three primary regions of the spectrum may be disposed as a single segmented layer.

The photographic emulsions useful for this invention are generally prepared by precipitating silver halide crystals in a colloidal matrix by conventionally know methods in the art. The colloid is typically a hydrophilic film-forming agent such as gelatin, alginic acid, or derivatives thereof.

The crystals formed in the precipitation step are washed and then chemically and spectrally sensitized by adding spectral sensitizing dyes and chemical sensitizers, and by providing a heating step during which the emulsion temperature is raised, typically from 40° C. to 70° C., and maintained for a period of time. The precipitation and spectral and chemical sensitization methods utilized in preparing the emulsions employed in the invention may be those methods known in the art.

Chemical sensitization of the emulsion typically employs sensitizers such as: sulfur-containing compounds, for example, allyl isothiocyanate, sodium thiosulfate and allyl thiourea; reducing agents, for example, polyamines and stannous salts; noble metal compounds, for example, gold, platinum; and polymeric agents, for example, polyalkylene oxides. As described, heat treatment is employed to complete chemical sensitization. Spectral sensitization is effected with a combination of dyes, which are designed for the wavelength range of interest within the visible or infrared spectrum. It is known to add such dyes both before and after heat treatment.

After spectral sensitization, the emulsion is coated on a support. Various coating techniques include dip coating, air knife coating, curtain coating and extrusion coating.

The silver halide emulsions utilized in this invention may be comprised of any halide distribution. Thus, they may be comprised of silver chloride, silver chloroiodide, silver bromide, silver bromochloride, silver chlorobromide, silver iodochloride, silver iodobromide, silver bromoiodochloride, silver chloroiodobromide, silver iodobromochloride, and silver iodochlorobromide emulsions. It is preferred, however, that the emulsions be predominantly silver chloride emulsions. By predominantly silver chloride, it is meant that the grains of the emulsion are greater than about 50 mole percent silver chloride. Preferably, they are greater than about 90 mole percent silver chloride; and optimally greater than about 95 mole percent silver chloride.

The silver halide emulsions may contain grains of any size and morphology. Thus, the grains may take the form of cubes, octahedrons, cubo-octahedrons, or any of the other naturally occurring morphologies of cubic lattice type silver halide grains. Further, the grains may be irregular such as spherical grains or tabular grains. Grains having a tabular or cubic morphology are preferred.

The photographic elements of the invention may utilize emulsions as described in The Theory of the Photographic Process, Fourth Edition, T. H. James, Macmillan Publishing Company, Inc., 1977, pages 151–152. Reduction sensitization has been known to improve the photographic sensitivity of silver halide emulsions. While reduction sensitized silver halide emulsions generally exhibit good photographic speed, they often suffer from undesirable fog and poor storage stability.

Generally, the photographic element is prepared by coating the subbed support film with one or more layers comprising a dispersion of silver halide crystals in an aqueous solution of gelatin. A gelatin containing protective overcoat is commonly the outermost layer in an imaging element.

Shown below is an example of different layers in a reversal film. The overcoat layer is composed of UV dye, unsensitized silver and gelatin.

Overcoat Layer
Blue Recording Layer Unit
Yellow Filter Layer
Green Recording Layer Unit
Interlayer
Red Recording Layer Unit
Subbing Layer
Photographic Support In the case of photographic elements for direct or indirect x-ray applications, one type of photographic element contains a sensitized emulsion on only one side of the support and a pelloid layer containing gelatin on the opposite side of the support from the imaging layer. Both negative and reversal silver halide elements are contemplated for use with the present invention. For reversal films, the emulsion layers as taught in U.S. Pat. No. 5,236,817, especially Examples 16 and 21, are particularly suitable. Any of the known silver halide emulsion layers, such as those described in Research Disclosure, Vol. 176, December 1978 Item 17643 and Research Disclosure Vol. 225, January 1983 Item 22534, the disclosures of which are incorporated by reference in their entirety, are useful in preparing photographic elements in accordance with this invention.

A typical multicolor photographic element of the invention comprises the support bearing a cyan dye image-forming unit comprising at least one red-sensitive silver halide emulsion layer having associated therewith at least one cyan dye-forming coupler, a magenta image-forming unit comprising at least one green-sensitive silver halide emulsion layer having associated therewith at least one magenta dye-forming coupler; and a yellow dye image-forming unit comprising at least one blue-sensitive silver halide emulsion layer having associated therewith at least one yellow dye-forming coupler and then the outermost protective overcoat.

The element may contain additional layers, such as filter layers, interlayers, and subbing layers. The support of the invention may also be utilized for black and white photographic print elements.

In the case of photographic elements for direct or indirect x-ray applications, one type of photographic element contains a sensitized emulsion on only one side of the support and a pelloid layer containing gelatin on the opposite side of the support. The dry coverage of a pelloid layer is typically in the range of 1000 to 2000 mg/m$^2$ as described in U.S. Pat. No. 5,866,287.

The photographic elements may also contain a transparent magnetic recording layer such as a layer containing magnetic particles on the underside, that is, the side opposite the imaging layer(s), of a transparent support, as in U.S. Pat. Nos. 4,279,945 and 4,302,523. Typically, the element will have a total thickness (excluding the support) of from 5 to 30 $\mu$m.

The photographic elements may be exposed with various forms of energy which encompass the ultraviolet, visible, and infrared regions of the electromagnetic spectrum as well as with electron beam, beta radiation, gamma radiation, x-ray, alpha particle, neutron radiation, and other forms of corpuscular and wave-like radiant energy in either noncoherent (random phase) forms or coherent (in phase) forms, as produced by lasers. When the photographic elements are intended to be exposed by x-rays, they may include features found in conventional radiographic elements.

The photographic elements are preferably exposed to actinic radiation, typically in the visible region of the spectrum, to form a latent image, and then processed to form a visible image, preferably by other than heat treatment. Processing is preferably carried out in the known RA-4® (Eastman Kodak Company) Process or other processing systems suitable for developing high chloride emulsions.

The thermal dye image receiving layer of a receiving elements used with the invention may comprise, for example, a polycarbonate, a polyurethane, a polyester, polyvinyl chloride, poly(styrene-co-acrylonitrile), poly (caprolactone), or mixtures thereof. The dye image receiving layer may be present in any amount that is effective for the intended purpose. In general, good results have been obtained at a concentration of from 1 to 10 g/m$^2$. An overcoat layer may be coated over the dye receiving layer, such as described in U.S. Pat. No. 4,775,657 of Harrison et al.

Dye donor elements that are used with the dye receiving element for use with the invention conventionally comprise a support having thereon a dye containing layer. Any dye may be used in the dye donor employed in the invention, provided it is transferable to the dye receiving layer by the action of heat. Especially good results have been obtained with sublimable dyes. Dye donors applicable for use in the present invention are described, for example, in U.S. Pat. Nos. 4,916,112; 4,927,803; and 5,023,228. As noted above, dye donor elements are used to form a dye transfer image. Such a process comprises image wise heating a dye donor element and transferring a dye image to a dye receiving element as described above to form the dye transfer image. In a preferred embodiment of the thermal dye transfer method of printing, a dye donor element is employed which compromises a poly(ethylene terephthalate) support coated with sequential repeating areas of cyan, magenta, and yellow dye, and the dye transfer steps are sequentially performed for each color to obtain a three color dye transfer image. When the process is only performed for a single color, then a monochrome dye transfer image is obtained.

Thermal printing heads which may be used to transfer dye from dye donor elements to receiving elements of the invention are available commercially. There may be employed, for example, a Fujitsu Thermal Head (FTP-040 MCS001), a TDK Thermal Head F415 HH7-1089, or a Rohm Thermal Head KE 2008-F3. Alternatively, other known sources of energy for thermal dye transfer may be used, such as lasers as described in, for example, GB No. 2,083,726A.

A thermal dye transfer assemblage of the invention comprises (a) a dye donor element, and (b) a dye receiving element as described above, the dye receiving element being in a superposed relationship with the dye donor element so that the dye layer of the donor element is in contact with the dye image receiving layer of the receiving element.

When a three color image is to be obtained, the above assemblage is formed on three occasions during the time when heat is applied by the thermal printing head. After the first dye is transferred, the elements are peeled apart. A second dye donor element (or another area of the donor element with a different dye area) is then brought in register with the dye receiving element and the process repeated. The third color is obtained in the same manner.

The electrographic and electrophotographic processes and their individual steps have been well described in the prior art. The processes incorporate the basic steps of creating an electrostatic image, developing that image with charged, colored particles (toner), optionally transferring the resulting developed image to a secondary substrate, and fixing the image to the substrate. There are numerous variations in these processes and basic steps; the use of liquid toners in place of dry toners is simply one of those variations.

The first basic step, creation of an electrostatic image, may be accomplished by a variety of methods. The electrophotographic process of copiers uses imagewise photodischarge, through analog or digital exposure, of a uniformly charged photoconductor. The photoconductor may be a single use system, or it may be rechargeable and reimageable, like those based on selenium or organic photoreceptors.

In one form, the electrophotographic process of copiers uses imagewise photodischarge, through analog or digital exposure, of a uniformly charged photoconductor.

In an alternate electrographic process, electrostatic images are created ionographically. The latent image is created on dielectric (charge holding) medium, either paper or film. Voltage is applied to selected metal styli or writing nibs from an array of styli spaced across the width of the medium, causing a dielectric breakdown of the air between the selected styli and the medium. Ions are created, which form the latent image on the medium.

Electrostatic images, however generated, are developed with oppositely charged toner particles. For development with liquid toners, the liquid developer is brought into direct contact with the electrostatic image. Usually a flowing liquid is employed to ensure that sufficient toner particles are available for development. The field created by the electrostatic image causes the charged particles, suspended in a nonconductive liquid, to move by electrophoresis. The charge of the latent electrostatic image is thus neutralized by the oppositely charged particles. The theory and physics of electrophoretic development with liquid toners are well described in many books and publications.

If a reimageable photoreceptor or an electrographic master is used, the toned image is transferred to paper (or other support). The support is charged electrostatically, with the polarity chosen to cause the toner particles to transfer to the support. Finally, the toned image is fixed to the support. For self-fixing toners, residual liquid is removed from the support by air drying or heating. Upon evaporation of the solvent, these toners form a film bonded to the support. For heat-fusible toners, thermoplastic polymers are used as part of the particle. Heating both removes residual liquid and fixes the toner to the support.

When used as ink jet imaging media, the recording elements or media typically comprise a substrate or a support material having on at least one surface thereof an ink receiving or image forming layer. If desired, in order to improve the adhesion of the ink receiving layer to the support, the surface of the support may be corona discharge treated prior to applying the solvent absorbing layer to the support or, alternatively, an undercoating, such as a layer formed from a halogenated phenol or a partially hydrolyzed vinyl chloride-vinyl acetate copolymer, may be applied to the surface of the support. The ink receiving layer is preferably coated onto the support layer from water or water-alcohol solutions at a dry thickness ranging from 3 to 75 micrometers, preferably from 8 to 50 micrometers.

Any known ink jet receiver layer may be used in combination with the external polyester based barrier layer of the present invention. For example, the ink receiving layer may consist primarily of inorganic oxide particles such as silicas, modified silicas, clays, aluminas, fusible beads such as beads comprised of thermoplastic or thermosetting polymers, nonfusible organic beads, or hydrophilic polymers such as naturally occurring hydrophilic colloids and gums such as gelatin, albumin, guar, xantham, acacia, chitosan, starches and their derivatives; derivatives of natural polymers such as functionalized proteins, functionalized gums and starches, and cellulose ethers and their derivatives; and synthetic polymers such as polyvinyloxazoline, polyvinylmethyloxazoline, polyoxides, polyethers, poly (ethylene imine), poly(acrylic acid), poly(methacrylic acid), n-vinyl amides including polyacrylamide and polyvinylpyrrolidone, and poly(vinyl alcohol), its derivatives and copolymers; and combinations of these materials. Hydrophilic polymers, inorganic oxide particles, and organic beads may be present in one or more layers on the substrate and in various combinations within a layer.

A porous structure may be introduced into ink receiving layers comprised of hydrophilic polymers by the addition of ceramic or hard polymeric particulates, by foaming or blowing during coating, or by inducing phase separation in the layer through introduction of nonsolvent. In general, it is preferred for the base layer to be hydrophilic, but not porous. This is especially true for photographic quality prints, in which porosity may cause a loss in gloss. In particular, the ink receiving layer may consist of any hydrophilic polymer or combination of polymers with or without additives as is well known in the art.

If desired, the ink receiving layer may be overcoated with an ink permeable, antitack protective layer such as, for example, a layer comprising a cellulose derivative or a cationically modified cellulose derivative or mixtures thereof. An especially preferred overcoat is poly $\mu$-1,4-anhydro-glucose-g-oxyethylene-g-(2'-hydroxypropyl)-N,N-dimethyl-N-dodecylammonium chloride. The overcoat layer is non porous, but is ink permeable and serves to improve the optical density of the images printed on the element with water based inks. The overcoat layer may also protect the ink receiving layer from abrasion, smudging, and water damage. In general, this overcoat layer may be present at a dry thickness of from 0.1 to 5 $\mu$m, preferably from 0.25 to 3 $\mu$m.

In practice, various additives may be employed in the ink receiving layer and overcoat. These additives include surface active agents such as surfactant(s) to improve coatability and to adjust the surface tension of the dried coating, acid or base to control the pH, antistatic agents, suspending agents, antioxidants, hardening agents to crosslink the coating, antioxidants, UV stabilizers, and light stabilizers. In addition, a mordant may be added in small quantities (from 2% to 10% by weight of the base layer) to improve waterfastness. Useful mordants are disclosed in U.S. Pat. No. 5,474,843.

The layers described above, including the ink receiving layer and the overcoat layer, may be coated by conventional coating means onto a transparent or opaque support material commonly used in this art. Coating methods may include, but are not limited to, blade coating, wound wire rod coating, slot coating, slide hopper coating, gravure, and curtain coating. Some of these methods allow for simultaneous coatings of both layers, which is preferred from a manufacturing economic perspective.

The DRL (dye receiving layer) is coated over the tie layer or TL at a thickness ranging from 0.1 to 10 $\mu$m, preferably from 0.5 to 5 $\mu$m. There are many known formulations, which may be useful as dye receiving layers. The primary requirement is that the DRL is compatible with the inks which it will be imaged so as to yield the desirable color gamut and density. As the ink drops pass through the DRL, the dyes are retained or mordanted in the DRL, while the ink solvents pass freely through the DRL and are rapidly absorbed by the TL. Additionally, the DRL formulation is preferably coated from water, exhibits adequate adhesion to the TL, and allows for easy control of the surface gloss.

For example, Misuda et al in U.S. Pat. Nos. 4,879,166; 5,264,275; 5,104,730; 4,879,166, and Japanese Patents 1,095,091; 2,276,671; 2,276,670; 4,267,180; 5,024,335; and 5,016,517 disclose aqueous based DRL formulations comprising mixtures of psuedo-bohemite and certain water soluble resins. Light in U.S. Pat. Nos. 4,903,040; 4,930,041; 5,084,338; 5,126,194; 5,126,195; and 5,147,717 discloses aqueous based DRL formulations comprising mixtures of vinyl pyrrolidone polymers and certain water dispersible and/or water soluble polyesters, along with other polymers and addenda. Butters et al in U.S. Pat. Nos. 4,857,386 and 5,102,717 disclose ink absorbent resin layers comprising mixtures of vinyl pyrrolidone polymers and acrylic or methacrylic polymers. Sato et al in U.S. Pat. No. 5,194,317 and Higuma et al in U.S. Pat. No. 5,059,983 disclose aqueous coatable DRL formulations based on poly(vinyl alcohol). Iqbal in U.S. Pat. No. 5,208,092 discloses water based DRL formulations comprising vinyl copolymers which are subsequently crosslinked. In addition to these examples, there may be other known or contemplated DRL formulations which are consistent with the aforementioned primary and secondary requirements of the DRL, all of which fall under the spirit and scope of the current invention.

The preferred DRL is from 0.1 to 10 micrometers thick and is coated as an aqueous dispersion of 5 parts alumoxane and S parts poly(vinyl pyrrolidone). The DRL may also contain varying levels and sizes of matting agents for the purpose of controlling gloss, friction, and/or fingerprint resistance, surfactants to enhance surface uniformity and to adjust the surface tension of the dried coating, mordanting agents, antioxidants, UV absorbing compounds, and light stabilizers.

The inks used in the aforementioned imaging process are well known, and the ink formulations are often closely tied to the specific processes, i.e., continuous, piezoelectric, or thermal. Therefore, depending on the specific ink process, the inks may contain widely differing amounts and combinations of solvents, colorants, preservatives, surfactants, and humectants. Inks preferred for use in combination with the image recording elements of the present invention are water based, such as those currently sold for use in the Hewlett-Packard Desk Writer 560C printer. However, it is intended that alternative embodiments of the image recording elements as described above, which may be formulated for use with inks which are specific to a given ink recording process or to a given commercial vendor, fall within the scope of the present invention.

The layers described above may be coated by conventional coating means onto a transparent or opaque support material commonly used in this art. Coating methods may include, but are not limited to, blade coating, wound wire rod coating, slot coating, slide hopper coating, gravure, and curtain coating. Some of these methods allow for simultaneous coatings of both layers, which is preferred from a manufacturing economic perspective.

EXAMPLES

Materials

The experiment described below used laponite RDS, a synthetic clay, and Cloisite® Na, a natural montmorillonite clay, both from the Southern Clay Products, Inc, Gonzales, Tex., USA. The properties of the clays are listed in Table 1.

TABLE 1

Properties of the Clay.

| Type of clay | Aspect ratio, L:t By TEM | Surface area $m^2/g$ | Moisture content % | Cationic exchange capacity CEC (meq/100 g) |
|---|---|---|---|---|
| Cloisite ® $Na^+$ | 200:1 | 750 | 14 | 145 |
| Laponite RDS | 20–30:1 | 370 | 8 | 120 |
| Control | | | | |

The gelatin used in the examples is a type 4, class 30, non-deionized gelatin (30–122) The density of the gelatin is 1.34 g/$cm^3$.

Preparation of the Coating Solution:

Aqueous mixtures of 4% solid concentration of clay and gelatin at different compositions shown in Table 2 were made in a 50° C. water bath using a high shear device. A hardening agent of bis(vinylsulfonyl)methane (BVSM), was added at 1.8%(wt) of the gelatin. Surfactant was added. The suspension was allowed to stand overnight to produce a splayed, that is, intercalated and/or exfoliated, clay material.

The splaying, that is, intercalation and/or exfoliation, of the clay was characterized by X-ray diffraction. All XRD data were collected using a Rigaku RU-300 Bragg-Brentano diffractometer coupled to a copper rotating anode X-ray source. The diffractometer was equipped with a diffracted beam graphite monochromator, tuned to CuKα radiation, and a scintillation detector. Diffraction patterns were collected in reflection mode geometry from 2–40° 2θ at a rate of 2° 2θ/min. The (001) basel spacing was then calculated using the Bragg equation. The results are listed in Table 2.

TABLE 2

Composition of the coating solution

| coating solution | Dry ratio (wt %) gelatin | Cloisite ® Na | Laponite RDS | (001) Basel spacing A | State of Splay |
|---|---|---|---|---|---|
| S-1 (control) | 100 | 0 | | N/A | |
| S-2 | 99 | 1 | | no peak | exfoliation |
| S-3 | 97 | 3 | | no peak | exfoliation |
| S-4 | 95 | 5 | | no peak | exfoliation |
| S-5 | 90 | 10 | | 46 | intercalation |
| S-6 (control) | 0 | 100 | | 10 | virgin clay |
| S-7 (prior art) | 99 | | 1 | no peak | exfoliation |
| S-8 (prior art) | 95 | | 5 | no peak | exfoliation |

As illustrated in Table 2, inventive coating solutions S-2 through S-5 and prior art coating solutions S-7 and S-8, used in the present examples, have been splayed, that is, either exfoliated, intercalated or a combination thereof. Control coating solutions S-1 and S-6 demonstrate lack of intercalation or exfoliation.

Physical Property Enhancement

A free-standing film was produced to study the physical property of the outermost layer in an imaging element, either in the topcoat of the imaging side, or the pelloid layer in the backside, that is, the side of the support opposite the imaging layer side.

Each coating solution as described in Table 2 was coated on a bare polyethylene terephthalate (PET) film using a coating knife of 25 mil (635 micron) clearance. The coating was chill set to form the desired gel structure. The coating was then placed in ambient conditions to dry for at least two days. A free-standing film of around 1 mil (25 micron) in thickness was peeled off the PET film substrate and stored in a standard 50% RH/70° F. (39° C.) environment before further testing.

Once the free standing film was made, the tensile properties were characterized. All tests were performed according to the ASTM D 882-80a in a standard environment of 50% RH and 73° F. (23° C.). The tensile test was conducted using a Sintech 2 operated via Testwork version 4.5 software with an Instron frame and load cell. A load cell of 50 lbs (23 kg) and a pair of grips of one flat and one point face were used. The sample size was 6.35 mm wide by 63.5 mm gauge length. The crosshead speed was set at 10%/min. Five specimens were tested for each sample, and the average and standard deviation were reported. A coefficient of variation of 5% for the modulus, 12% for the tensile strength and 15% for the elongation to break was generally observed, which includes the variation in the material and the measurement. The mechanical properties for the outermost layer are listed in Table 3.

TABLE 3

Mechanical Properties

| Example | Coating solution | Cloisite ® conc. (wt %) | Laponite conc. | Young's modulus GPa | Break strength MPa |
|---|---|---|---|---|---|
| C-1 | S-1 (control) | 0 | | 3.3 | 89 |
| C-2 | S-7 (prior art) | — | 1 | 3.1 | 84 |
| C-3 | S-8 (prior art) | — | 5 | 3.4 | 89 |
| 1 | S-2 | 1 | | 3.5 | 88 |
| 2 | S-3 | 3 | | 4.7 | 97 |
| 3 | S-4 | 5 | | 5.9 | 97 |
| 4 | S-5 | 10 | | 8.3 | 111 |

Compared to pure gelatin (comparative example C-1), and prior art samples C-2 and C-3, the modulus and break strength of the inventive samples C-1 through C-4 are higher. Therefore, the inventive films are more durable.

Evaluation of Scratch Resistance

To study the scratch resistance of the outermost layer in an imaging element, either in the topcoat of the imaging side, or the pelloid layer in the backside, that is, the side of the support opposite the imaging layer side, a coating was made on a subbed support.

The coating solution was coated on a subbed polyethylene terephthalate (PET) film using a coating knife of 10 mil (254 micron) clearance. The coating was chill set to form desired gel structure. The coating was then placed in ambient conditions to dry for at least two days and stored in a standard 50% RH/70° F. (39° C.) environment before further testing. The resulting coating had a dry thickness of 0.4 mil (10 micron).

A sapphire stylus with a cone-shaped tip of a 3 micron radius was used to scratch the coating to examine the scratch resistance. A fixed load of 5 grams was applied. Scratched surfaces were then examined using optical microscope (Olympus BH-2) to examine the visibility of the scratch. The less visible the scratch, the better the scratch resistance. A rank was given afterwards according to Table 4:

TABLE 4

| Rank | visibility by OM |
|---|---|
| Good | no mark |
| Fair | slight mark |
| Poor | marks |

The resulting film performance is shown in Table 5.

TABLE 5

Film Performance

Figure 2:
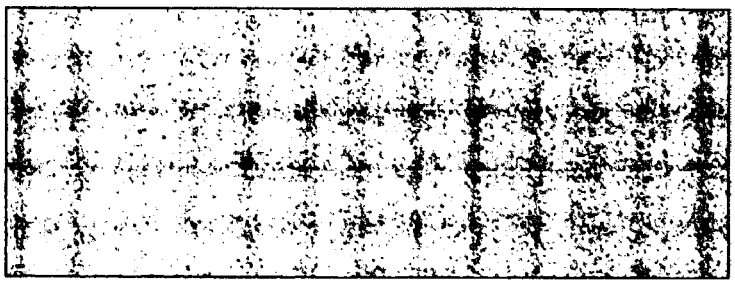
FIG. 2 illustrates the visual appearance of Example C-3, using coating solution S-7 (gelatin and 5% synthetic laponite), after being subjected to scratch resistance testing with 5 gm. constant load and 3 mil stylus.
Figure 3:
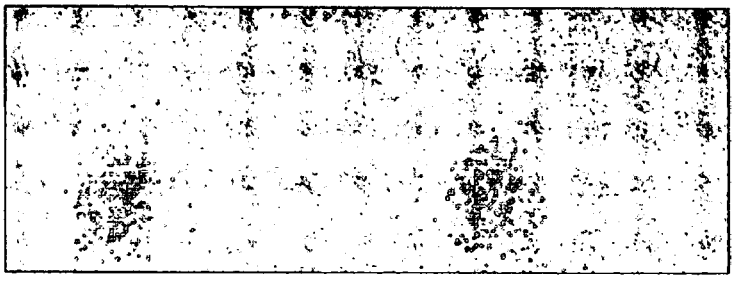
FIG. 3 illustrates the visual appearance of Example 6, using coating solution S-4 (gelatin and 5% cloisite®), after being subjected to scratch resistance testing with 5 gm. constant load and 3 mil stylus.
Figure 4:
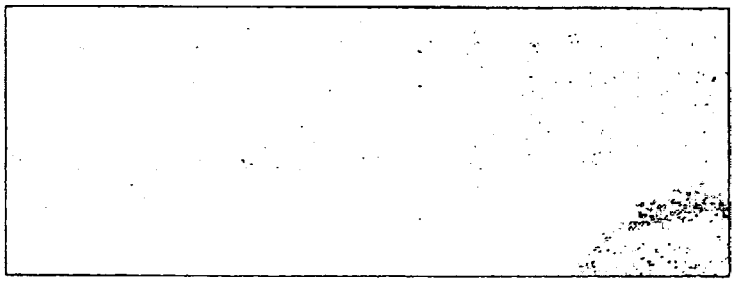
FIG. 4 illustrates the visual appearance of Example 7, using coating solution S-6 (gelatin and 10% cloisite®), after being subjected to scratch resistance testing with 5 gm. constant load and 3 mil stylus.

| Example | Coating solution | Cloisite ® concentration | Laponite concen-tration | Scratch Rank | Visual Appear-ance |
|---|---|---|---|---|---|
| C-2 | S-1 | 0 | | poor | See FIG. 1 |
| C-3 | S-7 (prior art) | — | 5 | poor | See FIG. 2 |
| 6 | S-4 | 5 | | fair | See FIG. 3 |
| 7 | S-6 | 10 | | good | See FIG. 4 |

The performance data in Table 5 illustrates that inventive samples 6 and 7 demonstrate improved scratch resistance over coatings containing no clay materials, as well as coatings of the prior art, containing synthetic clay materials.

The invention has been described in detail with particular reference to certain preferred embodiments thereof, but it will be understood that variations and modifications may be effected within the spirit and scope of the invention.

What is claimed is:

1. An imaging element comprising a support, an imaging layer, and at least one layer comprising a clay nanocomposite wherein said nanocomposite comprises a hydrophilic organic splayant and at least one natural clay particle splayed by said splayant having an aspect ratio of from 100:1 to 400:1, wherein said natural clay particle has a length greater than 0 and less than or equal to 700 nm (0.7 μm), and wherein said organic splayant comprises gelatin.

2. The imaging element of claim 1, wherein said at least one layer comprises an outermost layer.

3. The imaging element of claim 2 wherein said at least one outermost layer comprises a protective overcoat layer.

4. The imaging element of claim 1 wherein said imaging layer is between said support and said at least one layer.

5. The imaging element of claim 1 wherein said at least one layer is on the side opposite the imaging layer and the thickness of the said layer is from 8 to 50 microns.

6. The imaging element of claim 1 wherein said natural clay particle is intercalated by said splayant.

7. The imaging element of claim 1 wherein said natural clay particle is exfoliated by said splayant.

8. The imaging element of claim 1 wherein said natural clay particle comprises montmorillonite.

9. The imaging element of claim 1 wherein said natural clay particle comprises from 2 to 20 percent weight percent of said at least one layer.

10. The imaging element of claim 1 wherein said natural clay particle comprises from 2 to 10 parts by weight of said at least one layer.

11. The imaging element of claim 1 wherein said imaging element comprises a photographic imaging element.

12. The imaging element of claim 1 wherein said imaging element comprises a thermophotographic imaging element.

13. The imaging element of claim 1, wherein said support is selected from the group consisting of cellulose nitrate films, cellulose acetate films, poly(vinyl acetal) films, polystyrene films, poly(ethylene terephthalate) films, poly (ethylene naphthalate) films, polycarbonate films, glass, metals, papers and polymer-coated paper.

14. The imaging element of claim 1 wherein said at least one layer further comprises crosslinking agents, surfactants, thickeners, coalescing aids, particle dyes, matte beads and lubricants.

15. The imaging element of claim 1 wherein said at least one layer has a dry weight coverage of from 10 $mg/m^2$ to 10,000 mg/m.

16. The imaging element of claim 1 wherein said at least one layer has a dry weight coverage of from 200 to 2000 $mg/m^2$.

17. The imaging element of claim 1 wherein the Young's modulus of said support is enhanced by at least 10%.

18. The imaging element of claim 1 wherein the Young's modulus of said support is enhanced by at least 20%.

* * * * *